US011522297B2

(12) United States Patent
Ruhl

(10) Patent No.: US 11,522,297 B2
(45) Date of Patent: Dec. 6, 2022

(54) DEPLOYABLE CYLINDRICAL PARABOLIC ANTENNA

(71) Applicant: M.M.A. Design, LLC, Louisville, CO (US)

(72) Inventor: Lyn Eric Ruhl, Louisville, CO (US)

(73) Assignee: M.M.A. Design, LLC, Louisville, CO (US)

( * ) Notice: Subject to any disclaimer, the term of this patent is extended or adjusted under 35 U.S.C. 154(b) by 0 days.

(21) Appl. No.: 17/056,929

(22) PCT Filed: Mar. 27, 2019

(86) PCT No.: PCT/US2019/024346

§ 371 (c)(1),
(2) Date: Nov. 19, 2020

(87) PCT Pub. No.: WO2019/231538

PCT Pub. Date: Dec. 5, 2019

(65) Prior Publication Data

US 2021/0210861 A1 Jul. 8, 2021

Related U.S. Application Data

(60) Provisional application No. 62/677,959, filed on May 30, 2018.

(51) Int. Cl.
*H01Q 15/16* (2006.01)
*H01Q 19/15* (2006.01)
(Continued)

(52) U.S. Cl.
CPC ..... *H01Q 15/161* (2013.01); *H01Q 19/15* (2013.01); *H01Q 19/19* (2013.01); *H01Q 1/288* (2013.01)

(58) Field of Classification Search
CPC ..... H01Q 1/288; H01Q 3/01; H01Q 15/161; H01Q 19/10; H01Q 19/12; H01Q 19/15;
(Continued)

(56) References Cited

U.S. PATENT DOCUMENTS 5,440,320 A 8/1995 Lach et al.
5,992,120 A 11/1999 Meguro et al.
(Continued)

FOREIGN PATENT DOCUMENTS

CN 104009278 A * 8/2014
CN 104009278 B * 8/2016
WO WO-2016142724 A1 * 9/2016 ..... H01Q 3/01

OTHER PUBLICATIONS

Rahmat-Samii et al., "Advanced Precipitation Radar Antenna: Array-Fed Offset Membrane Cylindrical Reflector Antenna", IEEE Transactions on Antennas and Propagation, vol. 53, No. 8, Aug. 2005 (Year: 2005).*

(Continued)

*Primary Examiner* — Dameon E Levi
*Assistant Examiner* — Leah Rosenberg
(74) *Attorney, Agent, or Firm* — Holzer Patel Drennan

(57) ABSTRACT

A deployable antenna structure is provided that, in one embodiment, implements an offset feed, cylindrical parabolic antenna. The antenna structure employs a semi-rigid panel that can transition from a stowed state characterized by the retention of substantial strain energy to a deployed state characterized by less strain energy than in the stowed state but more than if the panel were in a strain-free state and a portion of the panel having a shape that closely conforms to a cylindrical parabolic shape.

12 Claims, 10 Drawing Sheets

(51) Int. Cl.
*H01Q 19/19* (2006.01)
*H01Q 1/28* (2006.01)

(58) Field of Classification Search
CPC .... H01Q 19/175; H01Q 19/19; H01Q 19/191; H01Q 19/193
See application file for complete search history.

(56) References Cited

U.S. PATENT DOCUMENTS 6,137,454 A * 10/2000 Peck ..... H01Q 15/161 343/912
6,775,046 B2 * 8/2004 Hill ..... H01Q 15/161 345/55
8,860,627 B2 * 10/2014 Scolamiero ..... H01Q 15/147 343/880
2004/0189545 A1 * 9/2004 Bekey ..... H01Q 15/147 343/912
2010/0263709 A1 10/2010 Norman et al.
2011/0187627 A1 8/2011 Palmer et al.
2015/0102973 A1 * 4/2015 Hand ..... H01Q 15/14 343/836
2019/0190146 A1 * 6/2019 Hand ..... H01Q 19/175

OTHER PUBLICATIONS

Bahadori K et al., "Advanced Precipitation Radar Antenna: Array-Fed Offset Membrane Cylindrical Reflector Antenna", IEEE Transactions on Antennas and Propagation, vol. 53, No. 8, Aug. 2005.
Liu Zhi-Quan et al., "Review of Large Spacecraft Deployable Membrane Antenna Structures", Chinese Journal of Mechanical Engineering, vol. 30, No. 6, Nov. 7, 2017.
Second Office Action Issued in Canadian Patent Application No. 3,101,314, dated Sep. 9, 2022, 4 Pages.

* cited by examiner 24
22
26

24
22
26

24
50A
48A
22
48B
50B
26

24
22
56B
60A
56A
26
58A
58B
60B

DEPLOYABLE CYLINDRICAL PARABOLIC ANTENNA

CROSS REFERENCE

This application is a National Stage Application of PCT/US2019/024346 filed on Mar. 27, 2019, which claims the benefit of U.S. Application No. 62/677,959, filed on May 30, 2018, the entirety of which is incorporated herein by reference.

STATEMENT REGARDING FEDERALLY SPONSORED RESEARCH

The invention was made with Government support under contract no. NNX17CP53P awarded by NASA. The Government has certain rights in the invention.

FIELD OF THE INVENTION

The invention relates to a deployable antenna structure and, more specifically, to a deployable antenna structure that includes a cylindrical parabolic reflector.

BACKGROUND OF THE INVENTION

Spacecraft, with few if any exceptions, require an antenna to perform their mission. In many cases, the operational form factor of such an antenna precludes the antenna from being transported on a launch vehicle for the spacecraft when the antenna is in its operational form factor. As such, deployable antenna structures have been developed that are capable of transitioning from a stowed state in which the antenna has a stowed form factor that can be accommodated on a launch vehicle to a deployed state in which the antenna has an operational form factor. One type of deployable antenna structure includes: (a) a flexible membrane that is capable of being folded into a stowed form factor which can be accommodated by a launch vehicle and at some point after launch being unfolded and shaped so as to be capable of functioning in an operational antenna structure and (b) a deployment structure that is also capable of being placed in a stowed form factor that can be accommodated by a launch vehicle and subsequently used to unfold and shape the flexible membrane for use as in an operational antenna structure. Typically, the deployment structure operates to shape the flexible membrane so as to serve as a reflecting structure in an operational antenna structure.

SUMMARY OF THE INVENTION

Presently, there is a need for spacecraft with antennas that have large apertures and are capable of high-frequency operation (e.g., Ku, Ka, and W bands). The ability of deployable antenna structures that employ flexible membranes to acceptably satisfy the operational requirements associated with such antennas is problematic. To elaborate, as the operational frequency of an antenna structure that employs a reflector increases, less surface roughness can be tolerated and more surface location precision is required of the reflector for acceptable operation. A deployable antenna structure that employs a flexible membrane to realize a reflector in an antenna structure and that has the surface roughness and surface location precision that is needed for acceptable high frequency operation (Ka band and above) is, due to the use of the flexible membrane, very challenging to achieve. Further, when the flexible membrane must also be used to realize a large aperture (i.e., cover a large area), the need for less surface roughness and more surface location precision over the extent of the aperture is even more challenging. While rigid structures are more readily capable of having the surface roughness and surface location precision needed for high frequency operation, in spacecraft applications in which a large aperture antenna is needed, such rigid structures are unlikely to be capable of being accommodated by the launch vehicle. As such, there is a need for a deployable antenna structure that is capable of high frequency and large aperture operation.

Generally, it has been found that a deployable antenna structure that is capable of high frequency and large aperture operation can be achieved with a cylindrical parabolic antenna that employs a reflector that can be transitioned from a stowed or undeployed state suitable for a launch vehicle to a deployed state in which the reflector has a reflective surface with a cylindrical parabolic-like shape. The reflector employs a semi-rigid sheet of reflective material that is capable of being placed in a stowed/undeployed state in which the sheet has a shape that satisfies the space requirements of a launch vehicle and that also has a substantial amount of strain energy, i.e., the sheet has elastic properties. Release of the strain energy in the sheet of material causes the sheet of material to transition from the shape associated with the stowed/undeployed state towards a shape in which the sheet retains little or no strain energy, i.e., a strain-free state. It has been found that one of the shapes that the sheet of material takes on during the transition from the stowed/undeployed state to a strain-free state closely conforms to that of a cylindrical parabolic. To take advantage of the occurrence of this cylindrical parabolic like shape, the deployable antenna system employs a deployment system that manages the transition of the sheet of material from the stowed/undeployed state towards the strain-free state such that the transition ceases when the cylindrical parabolic like shape is attained and before the strain-free state is reached. As such, the sheet of material still possesses strain energy when in the cylindrical parabolic like shape, but less energy than the sheet retained in the high-strain or stowed/undeployed state. It should be appreciated that the shapes of the sheet of reflective material in the undeployed/stowed state and the strain-free state can be any number of shapes, provided that at some point in the transition of the sheet from the undeployed state to the strain-free state, the sheet has a cylindrical parabolic like shape. Typically, the sheet of material will be flat in the strain-free state and curved in the high-strain or undeployed/stowed state (e.g., an Archimedean spiral, a cylinder-like shape, a partial cylinder-like shape, a planar curved shape, etc.). However, the sheet of material can be curved in the strain-free state and flat in the high-strain or undeployed/stowed state. Further, the sheet can have a first curved shape in the strain-free state and a second curved shape in the high-strain or undeployed/stowed state, where the first and second curved shapes are different. The deployment system maintains the cylindrical parabolic shape. To establish the cylindrical parabolic like shape, a first linearly extending section of the reflector is established so as to have a fixed angle relative to a reference surface, and the deployment system controls a second linearly extending section of the reflector that is parallel to the first linearly extending section such that the surface between the two linearly extending sections substantially conforms to a cylindrical parabolic shape.

An embodiment of a deployable antenna that is capable of providing high frequency and large aperture operation includes: (a) a base for supporting the other elements of the antenna and interfacing with a surface, such a surface being associated with a spacecraft, (b) a reflector operatively connected to the base and capable of having a cylindrical parabolic shape, (c) a feed antenna operatively connected to the base and positioned at the focus of the cylindrical parabolic shape associated with the reflector so as enable the transmitting and/or receiving of electromagnetic signals, and (d) a deployment system operatively connected to the base and used to transition the reflector from a stowed/undeployed state to an unstowed/deployed state in which the reflector has a cylindrical parabolic shape. The reflector is realized from a sheet of semi-rigid material that is capable of: (a) reflecting electromagnetic signals at the frequency or frequency band(s) of interest, (b) capable of being placed in a stowed/undeployed state characterized by having a shape suitable for accommodation on a launch vehicle and storing a substantial amount of strain energy, and (c) capable of being placed in an unstowed/deployed state characterized by the presentation of a surface with a cylindrical parabolic like shape and the storage of a lesser amount of strain energy than in the undeployed state but more than if the reflector were allowed to enter a strain-free or substantially strain-free state. In a particular embodiment, the reflector is realized from a rectangular sheet of a semi-rigid material. One edge of the sheet is connected to the base at a fixed angle to the base (e.g., 90° to the base). The deployment system operates to allow the sheet to transition from the undeployed state to the deployed state in which the sheet has a cylindrical parabolic shape and to maintain this shape by applying a force to the edge of the sheet that is opposite to the edge that is attached to the base to counteract the internal force associated with remaining strain energy retained in the reflector. As such, the reflector/sheet is prevented from reaching the strain-free state. In a particular embodiment, the force is applied to the edge of the sheet using a lanyard system. In another embodiment, a lanyard system is used to apply a force to a stand-off member that extends away from the edge of the sheet. Application of a force to the stand-off member provides a more robust method for affecting the shape of the reflector.

In one embodiment, the deployable antenna structure, when in the deployed state, is in an offset feed, cylindrical parabolic antenna. With the addition of a sub-reflector, an offset feed, cylindrical parabolic, Cassegrain/Gregorian antenna configurations can be achieved. Typically, the sub-reflector has an unstowed/deployed shape that satisfies launch vehicle requirements and, as such, does not require a transition from a stowed/undeployed shape to the unstowed/deployed shape.

It should be appreciated that the cylindrical parabolic shape of the reflector in the unstowed/deployed state is not a "perfect" cylindrical parabolic shape. At lower frequencies, deviations from the "perfect" cylindrical parabolic shape can be tolerated and adequate operation achieved. However, at high frequencies, less perfection in the cylindrical parabolic shape can be tolerated. For instance, the reflective surface needs to be less rough and must have greater surface location precision. In one embodiment of the deployable antenna structure, a "tunable" material is used to realize a reflector that has satisfactory roughness and/or surface location precision. In a particular embodiment, the "tunable" material is a carbon-fiber composite. The stiffness of the reflector made from a carbon-fiber composite can be adjusted relative to an isotropic sheet of material to achieved acceptable surface roughness and/or surface location precision by the incorporation of one or a combination of local stiffeners, the addition/removal of plies, the addition of spacers, and material selection. As such, the resulting sheet of carbon-fiber composite material is capable of presenting a cylindrical parabolic like surface that is closer to a mathematically ideal surface. However, the sheet may no longer have a constant cross-section. In another embodiment, unacceptable surface roughness and/or surface location precision associated with the reflector is addressed by using a sub reflector that compensates for these shortcomings. Yet another embodiment addresses unacceptable surface roughness and/or surface location precision by disposing a reflectarray antenna element adjacent to a location on the reflector that has unacceptable roughness and/or surface location precision and tuning the element or elements to compensate for the unacceptable surface roughness and/or surface location precision at that location and thereby facilitate high frequency operation. Notably, at lower frequencies, the reflectarray antenna element used to compensate for the shortcomings of the reflector at higher frequencies are electrically insignificant at lower frequencies. As such, a reflector with one or more reflectarray elements attached to the reflector to compensate for unacceptable surface roughness and/or surface location precision at higher frequencies is also capable of operating at lower frequencies. If a significant array of reflectarray antenna elements are associated with the reflector, steering of the portion of the beam that engages the elements is also feasible. In yet another embodiment, the unacceptable surface roughness and/or surface location precision is addressed using one or more piezoelectric actuators that are attached to the rear of the reflector. In operation, the length of such a piezoelectric actuator is proportional to the amount of electrical current that is applied to the actuator. As such, a piezoelectric actuator that is attached to the reflector can be used to affect the shape of the portion of the reflector that is immediately adjacent to the actuator and thereby address unacceptable roughness and/or surface location precision present in that portion of the reflector.

DETAILED DESCRIPTION

The present invention is directed to a deployable antenna structure that includes a reflector that is capable of being placed in a stowed/undeployed state and an unstowed/deployed state characterized by the reflector having a cylindrical parabolic shape.

Figure 1A:
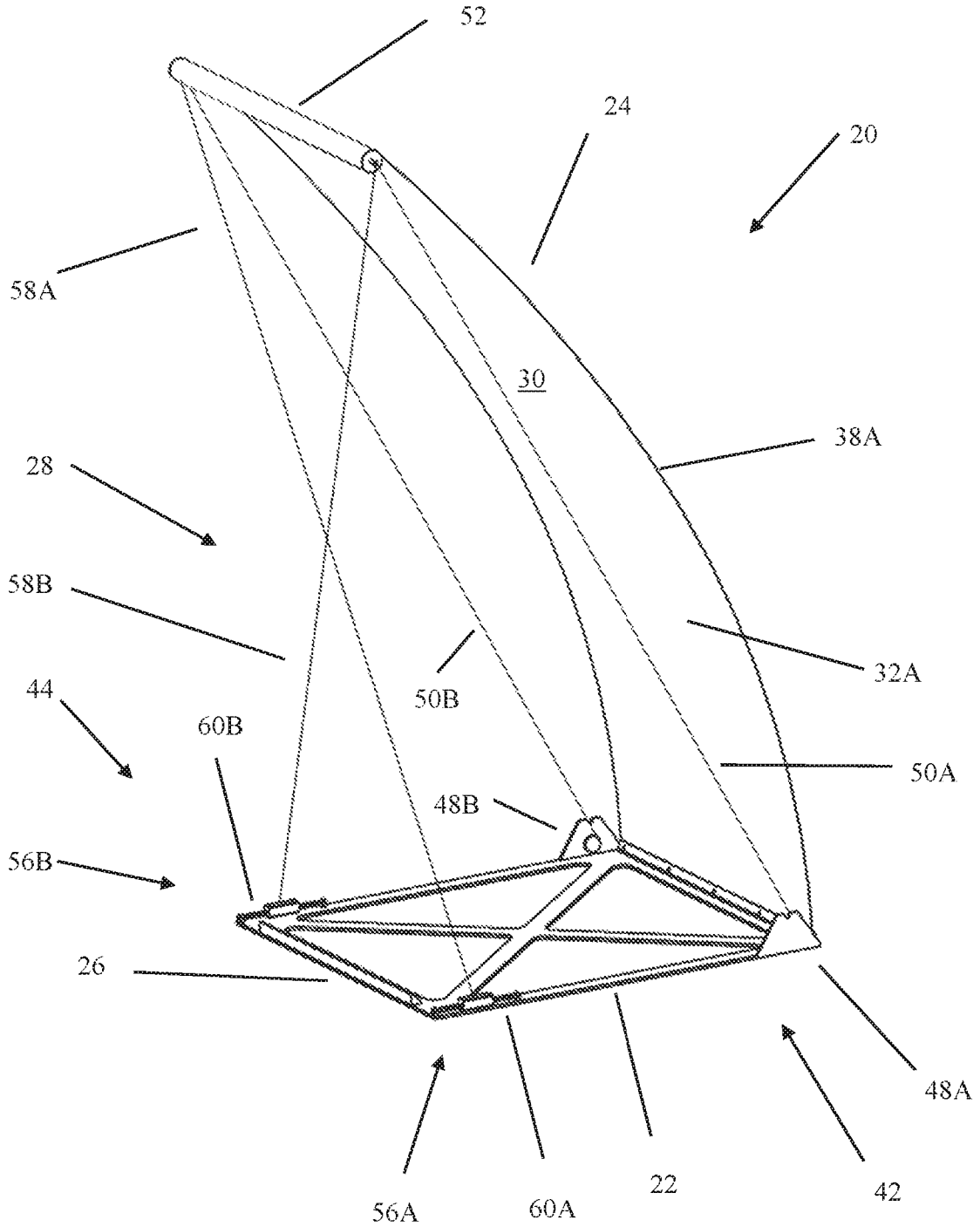
FIG. 1A is a perspective view an embodiment of a deployable antenna structure in a deployed state, the structure including a reflector that is capable of transitioning from a stowed/undeployed state to an unstowed/deployed state in which reflector has a cylindrical parabolic shape.
Figure 1B:
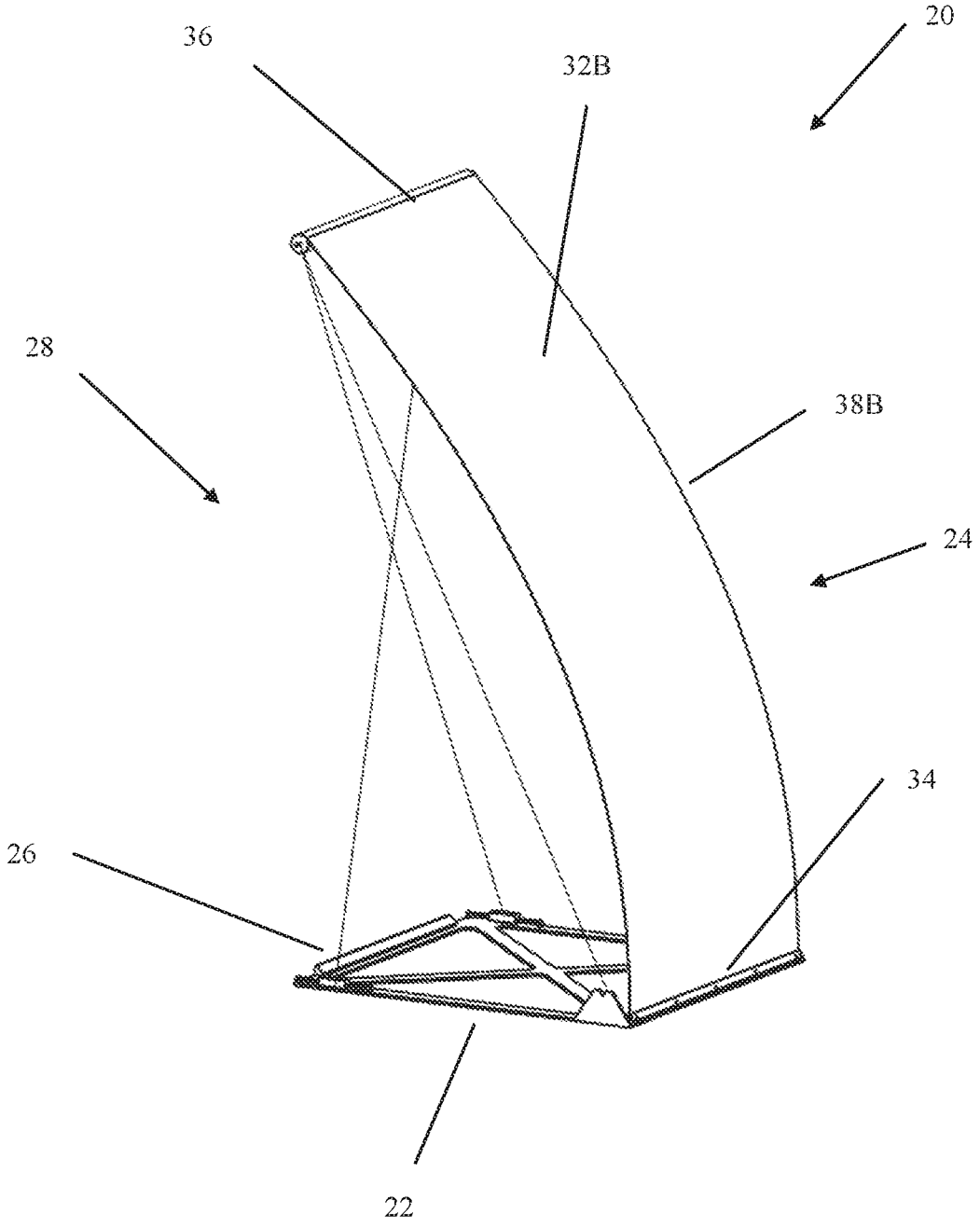
FIG. 1B is a rear perspective view of the embodiment of a deployable antenna structure shown in FIG. 1A.

With reference to FIG. 1, an embodiment of a deployable antenna structure 20 that includes a reflector capable of being placed in a stowed/undeployed state and an unstowed/deployed state characterized by the reflector having a cylindrical parabolic shape is described. The deployable antenna structure 20 may be occasionally referred to hereinafter as antenna structure 20 or antenna 20. The deployable antenna structure 20 includes a base 22, a reflector 24, a linear feed antenna 26, and a deployment system 28.

The base 22 serves as a structure for supporting the other elements of the deployable antenna structure 20 and as an interface for connecting the deployable antenna structure 20 to a spacecraft or other surface. The base 22 is shown as being planar. However, a base with a different shape that is needed or desirable is feasible. Further, the base 22 is shown as having a number of triangular cut-outs that reduce the mass of the base 22. However, in applications in which mass is less of a concern, a base without cut-outs or fewer cut-outs is feasible. It is also feasible that a surface of a spacecraft or other structure serves as the base for supporting the other elements of the deployable antenna structure 20.

Figures 2A, 2B, 2C, 2D:
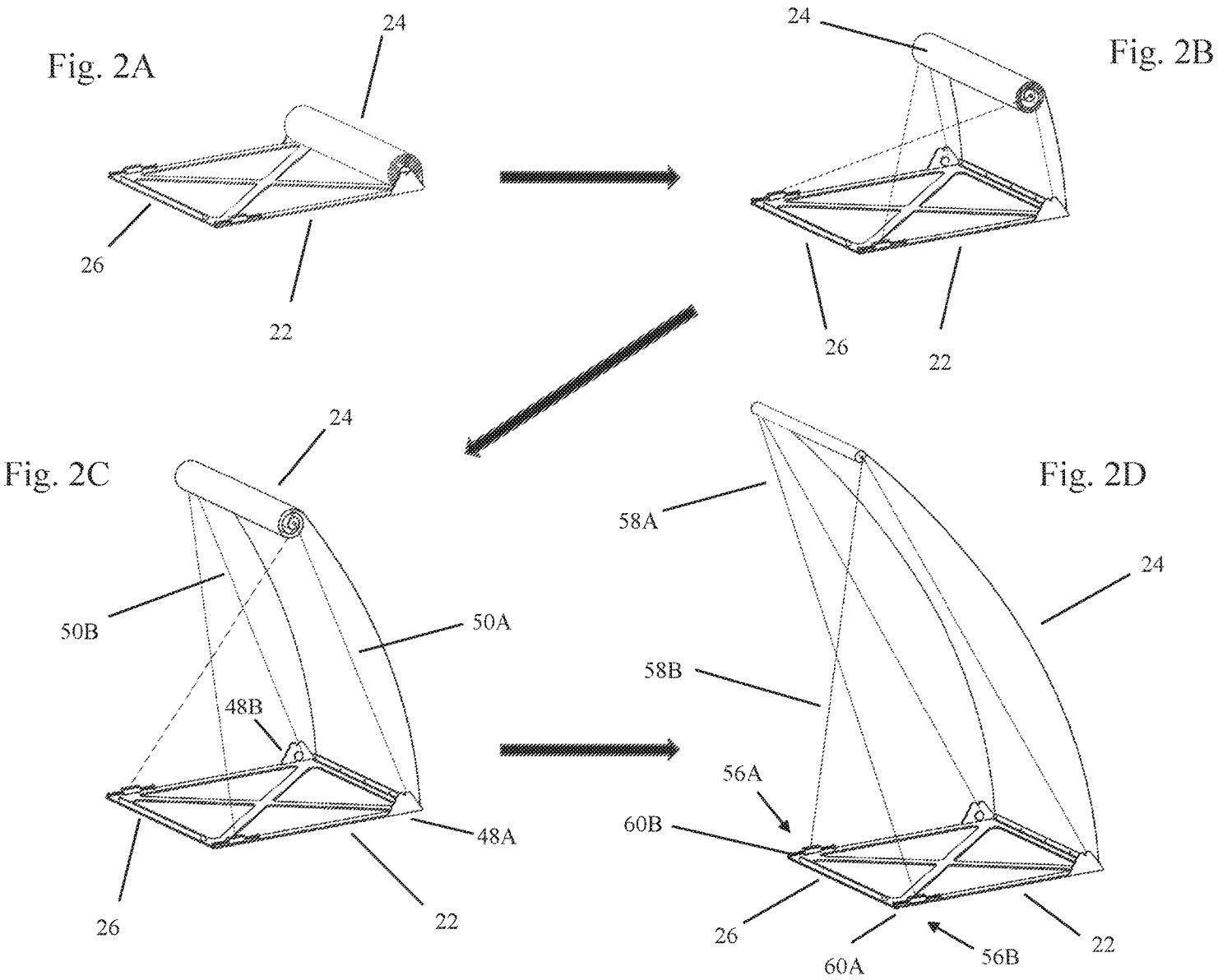
FIG. 2A-2D illustrate the deployment sequence of the embodiment of the deployable antenna structure shown in FIGS. 1A and 1B.

The reflector 24 provides a reflective surface 30 that is capable of reflecting electromagnetic waves received by the antenna 20 to the linear feed antenna 26 and/or reflecting electromagnetic waves produced by the linear feed antenna 26 for transmission from the antenna 20. With reference to FIG. 2A, the reflector 24 is capable of being placed in a stowed/undeployed state characterized by a substantial portion of the reflector being disposed in an Archimedean spiral and an unstowed/deployed state (FIGS. 1A and 1B) characterized by a portion of the reflective surface 30 having a cylindrical parabolic like shape needed for the antenna to transmit and/or receive electromagnetic signals. In the stowed state, the reflector 24 stores a substantial amount of strain energy that is subsequently used in transitioning the reflector from the stowed state towards the deployed state. Characteristic of the deployed state is that the reflector 24 still retains some of the strain energy that was present in the stowed state. This remaining strain energy in the deployed state is used, in conjunction with the deployment system 28, to maintain the reflector 24 in the deployed state with the reflective surface 30 having the cylindrical parabolic like shape. In addition, the remaining strain energy is used, in conjunction with the deployment system 28, to "tune" the shape of the reflector 24 following deployment, if needed. Notably, the strain energy stored in the reflector 24 in the deployed state is substantially less than the strain energy stored in the reflector 24 in the stowed or undeployed state. However, the strain energy stored in the reflector 24 in the deployed state is more than the strain energy stored in the reflector if the reflector were allowed to return to a strain-free state. In the illustrated embodiment, the reflector 24 is, if laid flat, a rectangular panel that has a first planar side 32A and a second planar side 32B that is parallel to the first planar side 32B. Further, the reflector 24 has an edge that extends between the first and second planar sides 32A, 32B and is comprised of fixed, straight edge 34 that has a fixed angle relative to the base 22 (e.g., 90°), a free, straight edge 36 opposite the fixed, straight edge 34, and a pair of side edges 38A, 38B. The reflector 24 has a constant cross-section, i.e., if the panel is laid flat, the perpendicular distance from the first side 32A to the second side 32B is the same for any point associated with the first side 32A or second side 32B. Further, the reflector 24 is mechanically isotropic. In the illustrated embodiment, the reflector 24 is made of an isotropic, high strain, carbon fiber composite. The high strain characteristic of the composite allows the reflector 24 to be placed in the Archimedean spiral roll characteristic of the stowed state (FIG. 2A) and to store a considerable amount of strain energy that can be used in deploying the reflector 24 and, if needed, tuning the reflector 24 following deployment. It should be appreciated that, depending on the form factor required of the reflector in the stowed/undeployed state, other types of materials may possess the necessary characteristics to transition from a stowed/undeployed state to a deployed state that is intermediate to the stowed/undeployed state and a strain-free state with a portion of the reflective surface having a cylindrical parabolic like shape. For instance, in a particular application, a spring steel may have the necessary characteristics.

The linear feed antenna 26 is a one-dimensional or linear array of radiators that is positioned at the focal line of the portion of the deployed reflector 24 that nominally approximates a cylindrical parabolic. The linear feed antenna 26 is adapted to have a beam pattern that is pie-shaped and extends over a substantial portion of the width of the reflector 24.

The deployment system 28 operates to manage the strain energy stored in the reflector 24 in the stowed/undeployed state to place the free, straight edge 36 of the reflector 24 at the location needed, relative to the fixed, straight edge 34, for a portion of the reflective surface 30 to have a cylindrical parabolic like shape. Generally, this location results in the free, straight edge 36 being substantially parallel to the fixed, straight edge 34. The deployment system 28 includes a restraint-release system 42 that holds the reflector 24 in the stowed/undeployed state characterized by a substantial portion of the reflector 24 being disposed in an Archimedean spiral roll (FIG. 2A) and implements a controlled release of the reflector 24 that allows the reflector to transition to the deployed state (FIG. 2D). In this regard, the restraint-release system 42 establishes the free, straight edge 36 at the position needed to realize the cylindrical parabolic like shape. The deployment system 28 further includes a maintenance system 44 that maintains the free, straight edge 36 at the position needed to force the reflective surface 30 to have the cylindrical parabolic like shape and, if needed, to make adjustments to the position of the free, straight edge to improve the cylindrical parabolic like shape of the reflective surface 30 (e.g., to compensate for thermal expansion).

The restraint-release system 42 includes a pair of restraint-controlled release structures 48A, 48B that operate to hold the reflector 24 in the stowed/undeployed state (FIG. 2B), release the reflector 24 from the stowed/undeployed state at a desired point in time, and, after release, control the rate at which the free, straight edge 36 moves towards the location needed to establish the cylindrical parabolic shape. To releasably retain the reflector 24 in the stowed/undeployed state, the structures 48A, 48B use electromechanical latches but can be adapted to use any of the structures known to those skilled in the art. To control the movement of the free, straight edge 36, the structures 48A, 48B respectively include damped reels for paying out lanyards 50A, 50B that each have an end that is operatively attached to the free, straight edge 38. In the illustrated embodiment, the ends of the lanyards 50A, 50B are attached to a stiffening member 52 that is, in turn, attached to the free, straight edge 36. The stiffening member 52 prevents the reflector from bowing due to the operation of the restraint-release system 42 and/or maintenance system 44. In certain embodiments, the reflector 24 may be laterally stiff enough that a stiffening member 52 is unnecessary, and a different mechanism can be used to connect the lanyards 50A, 50B to the free, straight edge 36.

The maintenance system 44 includes a pair of maintenance-adjustment structures 56A, 56B that is used to maintain the position of the free, straight edge 36 of the reflector 24 established by the operation of the restraint-release system 42 and adjust the position of the free, straight edge 36 so established. The maintenance-adjustment structures 56A, 56B operate to maintain the position of the free, straight edge 36 of the reflector 24 using lanyards. To elaborate, maintenance-adjustment structure 56A, 56B respectively pay out lanyards 58A, 58B that each have an end that is connected to the stiffening member 52 during the transition of the reflector between the deployed and undeployed states. The lengths of the lanyards 58A, 58B limit the position of the free, straight edge 36 from moving beyond a certain point. As such, the lanyards 58A, 58B are used to apply a force to reflector 24 at the free, straight edge 36 that balances the force generated by the remaining strain energy in the reflector that is endeavoring to force the reflector 24 to whatever shape is associated with the strain-free state of the reflector 24. Further, the lanyards 58A, 58B are crossed to produce a truss-like structure that resists forces that might distort the shape and/or position of the reflector. Additionally, the maintenance-adjustment structures 56A, 56B can adjust the position of the free, straight edge 36. To elaborate, each of the maintenance-adjustment structures 56A, 56B can, to a limited extent, adjust the length of its lanyard. Further, each of the maintenance-adjustment structures 56A, 56B can adjust the direction at which its lanyard applies a force to the free, straight edge 36 by moving linearly along tracks 60A, 60B. The ability to adjust the length of the lanyards 58A, 58B and the direction from which the lanyards apply forces to the free, straight edge of the reflector 24 each provide the ability to tune the cylindrical parabolic shape of the reflective surface 30, if needed. For example, such tuning may be needed to compensate for thermal expansion/contraction or material relaxation/creep, to name a few.

With reference to FIGS. 2A-2D, the transition of the deployable antenna structure 20 is described. The deployable antenna structure 20 is shown in the stowed/undeployed state in FIG. 2A. Characteristic of the stowed/undeployed state is that the reflector 24 is disposed in an Archimedean spiral roll and is retaining a substantial amount of strain energy. At some point in time, the deployable antenna structure needs to transition from the stowed/undeployed state to the unstowed/deployed state. This transition commences with the restraint-controlled release structures 48A, 48B releasing the electromechanical latches or other restraining structures that are holding the reflector 24 in the stowed/undeployed state. In response, the strain energy stored in the reflector begins to cause the shape of the reflector 24 to change. More specifically, the strain energy causes the Archimedean spiral roll of the reflector 24 to begin to unroll or unwind. Further, the restraint-controlled release structures 48A, 48B begin to dispense the lanyards 50A, 50B in a manner that controls the rate at which free, straight edge 36 moves toward the position it will occupy at the end of deployment and that will be at or near the position needed to impose a cylindrical parabolic shape on the reflective surface 30 (FIGS. 2A and 2B). Once the restraint-controlled release structures 48A, 48B have completely paid out the lanyards 50A, 50B, the maintenance system 44 operates to maintain the free, straight edge 36 at the location established by the restraint-controlled release structures 48A, 48B (FIG. 2D). If needed, the maintenance-adjustment structures 56A, 56B can be used to adjust the lengths of the lanyards 58A, 58B and/or the direction from which the lanyards are applying forces to the free, straight edge 36 of the reflector 24. In the illustrated embodiment, the undeployed reflector is in an Archimedean spiral roll with a diameter of about 15 cm and a width of about 100 cm. In the deployed state, the reflector 24 occupies a space that is approximately 2 m in height, 1 m in depth, and 1 m in width. Further, the orientations of the reflector 24 and the linear feed antenna 26 establish what is known as an offset feed, cylindrical parabolic antenna.

Figure 3:
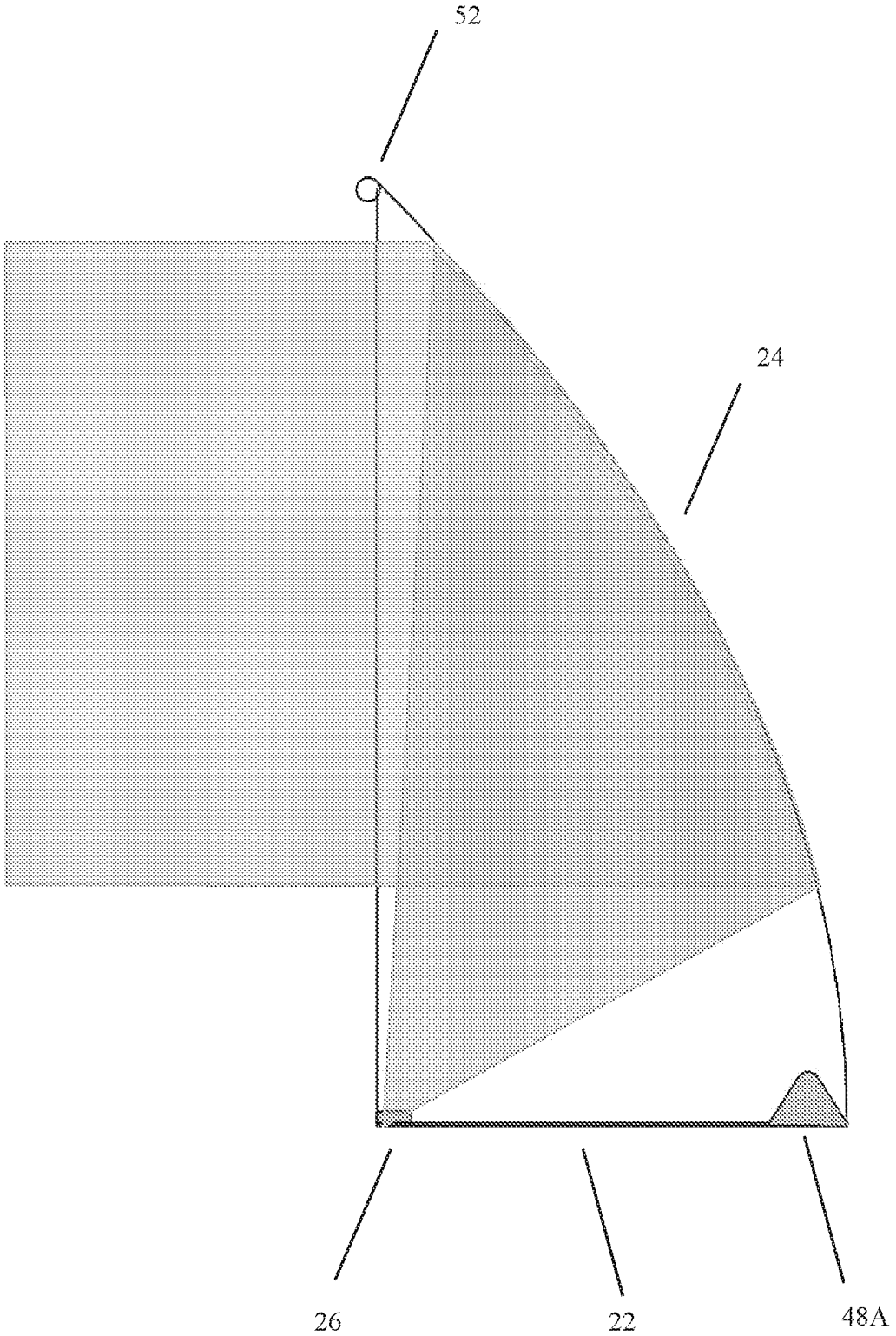
FIG. 3 illustrates the beam projection achieved with the deployable antenna structure shown in FIG. 1 when a feed antenna with 62° field of view is utilized.

With reference to FIG. 3, when the deployable antenna structure 20 is in operation with the linear feed antenna 26 producing a 62° beam pattern and a focal length of 100 cm, the reflective surface 30 yields an aperture for the antenna of about 150 cm.

When the deployable antenna structure is used to process high-frequency signals (i.e., signals in Ka band and higher bands) isotropic, carbon-fiber composites may not be smooth enough (i.e., be too rough) and/or not have the necessary surface location precision to adequately function at these frequencies. However, carbon fiber composites can be used to realize a mechanically non-isotropic reflector 24 that is "tuned" so as to satisfy the surface roughness and surface location precision needed for the antenna structure 20 to achieve adequate operation at high frequencies. To elaborate, a reflector 24 that satisfies the surface roughness and/or surface location precision needed for high frequency operation can be realized with a carbon fiber composite panel that exhibits varying stiffness over the extent of the reflector 24, thereby allowing a "more perfect" cylindrical parabolic surface to be achieved. Such tuning of the reflector 24 can potentially be achieved by one or more of: controlling the number and location of the layers in the carbon fiber composite, employing local stiffeners, removing plies, adding plie, and material choices to name a few of the possibilities. In addition, depending on the shape that the reflector 24 must take in the stowed/undeployed state, other types of material may satisfy the surface roughness and surface location precision required for high frequency operation. For instance, if the stowed/undeployed state allows for the reflector 24 to have a planar shape, a spring steel that exhibits satisfactory surface roughness and surface location precision may be suitable material for fashioning the reflector 24.

Figure 4:
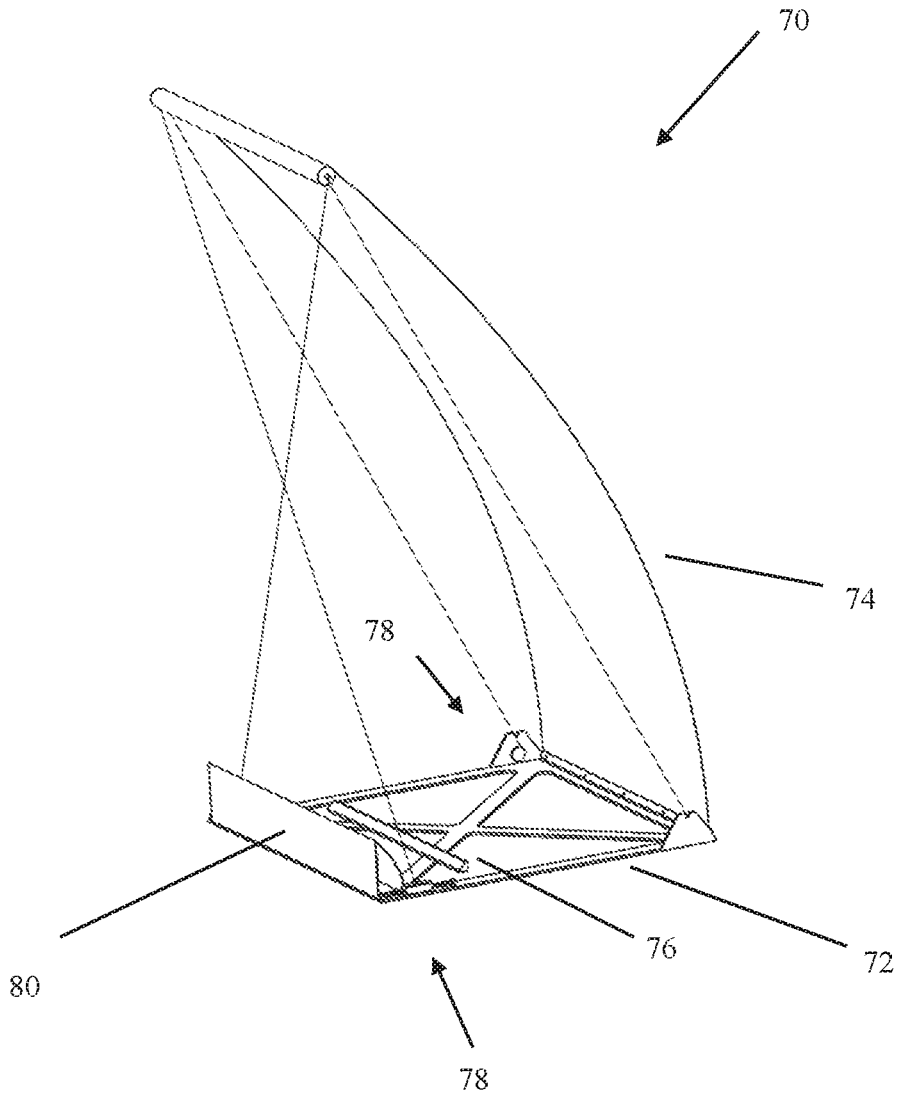
FIG. 4 illustrates a second embodiment of a deployable antenna structure with a Cassegrain architecture that includes a reflector which is capable of transitioning from a stowed/undeployed state to an unstowed/deployed state in which the reflector has a cylindrical parabolic shape.

Another way to realize a deployable antenna structure that is capable of satisfying the surface roughness and surface location precision requirements needed for high frequency operation is to employ a reflector that has unsatisfactory surface roughness and/or inadequate surface location precision for high frequency operation in conjunction with a sub-reflector that corrects the errors associated with using such a reflector to a degree that high frequency operation is achievable. With reference to FIG. 4, a deployable antenna structure 70 that includes a correcting sub-reflector is described. The deployable antenna structure 70 includes a base 72, a reflector 74, a linear feed antenna 76, and a deployment system 78. However, the deployable antenna structure 70 also includes a convex sub-reflector 80 that is tuned to compensate for the surface roughness and/or lack of surface location precision associated with the reflector 74. The positional relationships of the reflector 74, linear feed antenna 76, and convex sub-reflector 80 yield a Cassegrain configuration. Consequently, an electromagnetic signal received by the deployable antenna structure 70 is reflected by the reflector 74 to the convex sub-reflector 80, which, in turn, reflects the signal to the linear feed antenna 76. An electromagnetic signal to be transmitted by the deployable antenna structure 70 is directed from the linear feed antenna 76 to the convex sub-reflector 80, which, in turn, reflects the signal to the reflector 74. It should be appreciated that a Gregorian configuration is also feasible.

Figure 5:
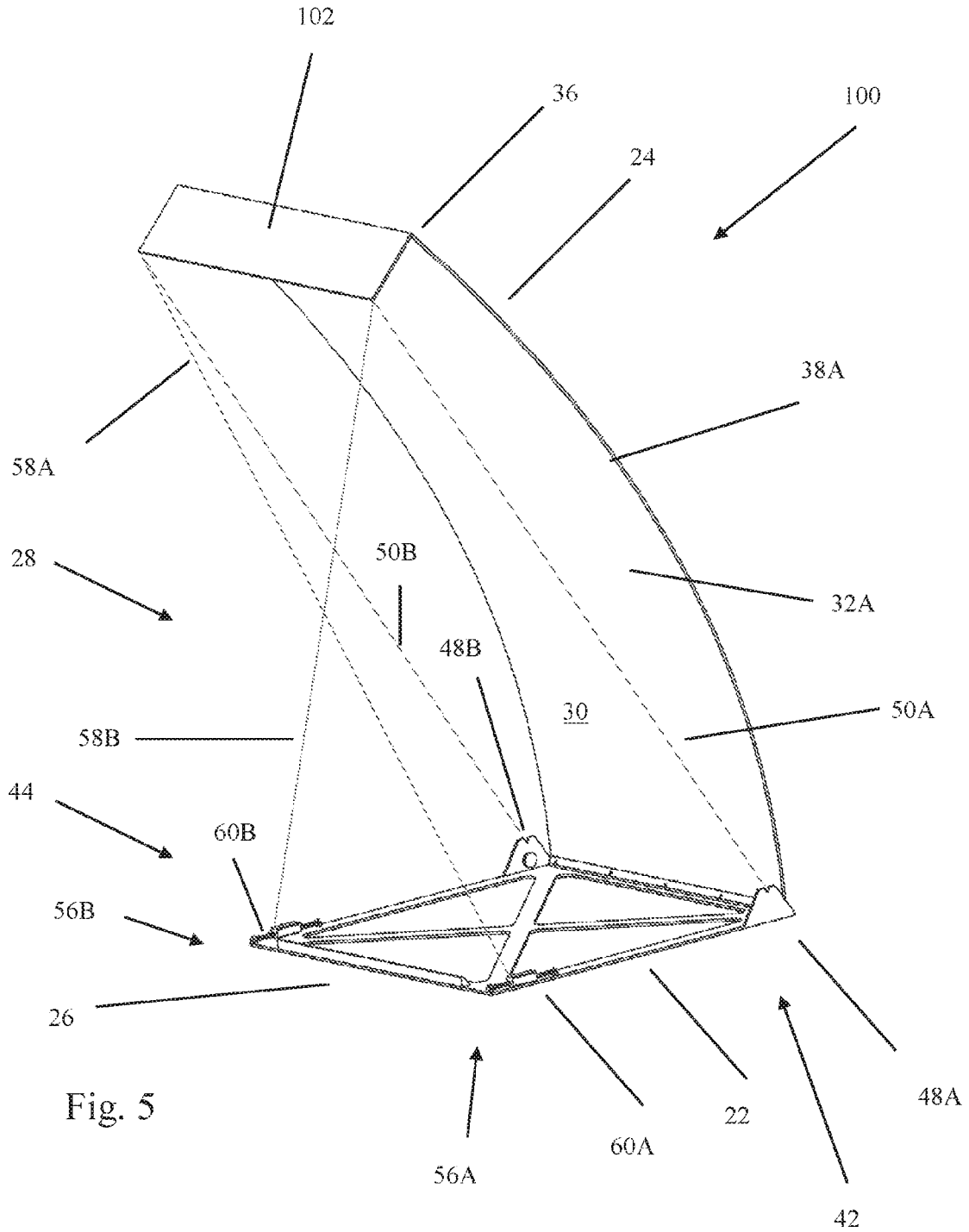
FIG. 5 is a perspective view of another embodiment of a deployable antenna structure that employs a standoff which is attached to the free edge of the reflector to facilitate the shaping of the reflector by the lanyards attached to the standoff

With reference to FIG. 5, another embodiment of a deployable antenna structure 100 (hereinafter "antenna structure 100) is described. The antenna structure 100 has a number of elements that serve the same or substantially the same purpose as the corresponding elements described with respect to antenna structure 20. These elements of antenna structure 100 are given the same reference numbers as having been accorded the corresponding elements of antenna structure 20 and will not be described further. The antenna structure 100 has a standoff 102 that extends away from the free, straight edge 36 of the reflector 24. The lanyards 50A, 50B, 58A, 58B are operatively attached to the standoff 102 at a location that is spaced from the free, straight edge 36. By attaching the lanyards 50A, 50B, 58A, 58B at a location that is spaced from the free, straight edge 36 of the reflect, the lanyards can be used to impart more robust shaping forces to the reflector 24 than can be achieved in antenna structure 20 where the lanyards are attached closer to the free, straight edge 36 of the reflector 24.

Figure 6:
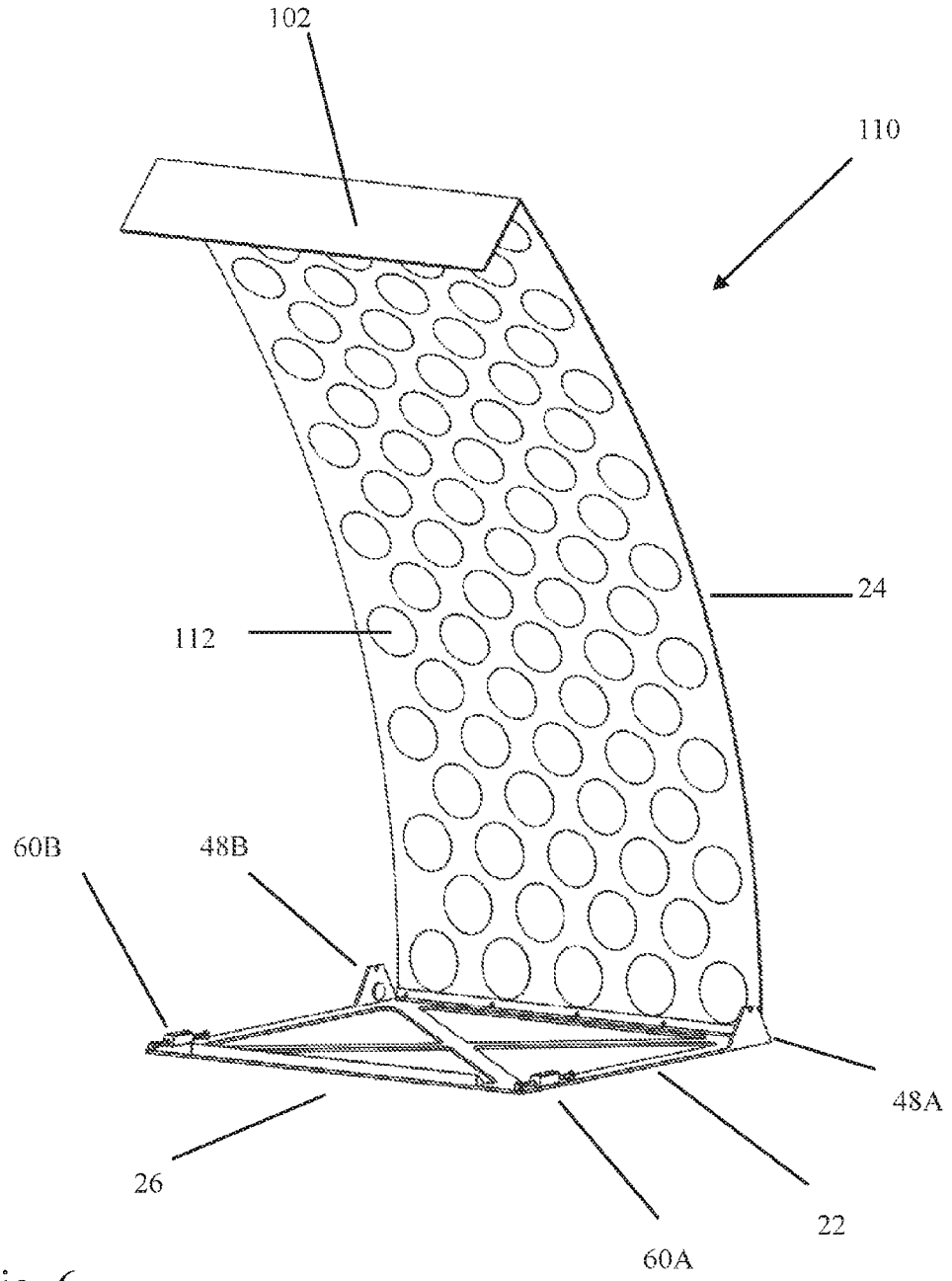
FIG. 6 is a perspective view of a third embodiment of a deployable antenna structure that includes an array of reflectarray antenna elements that are attached adjacent to the reflector and used to compensate for unacceptable roughness and/or surface location precision in the reflector that would otherwise degrade high frequency performance.
Figure 7:
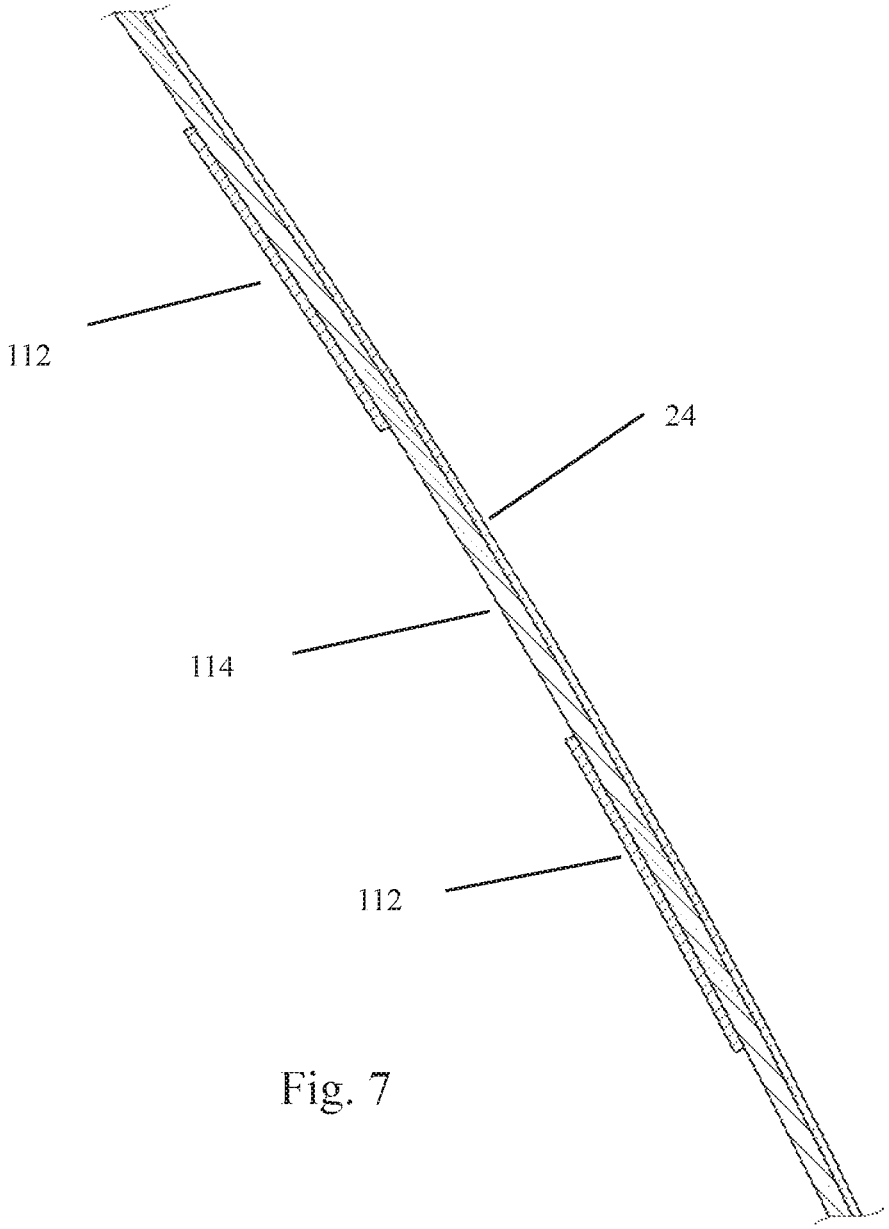
FIG. 7 is a cross-sectional view of a portion of the reflector and associated reflectarray elements of the embodiment of the deployable antenna structure shown in FIG. 5.

With reference to FIG. 6, another embodiment of a deployable antenna structure 110 (hereinafter "antenna structure 110") is described. The antenna structure 110 has been illustrated without the lanyards for clarity. However, it should be appreciated that an operational antenna structure 110 would have lanyards as previously described with respect to the other embodiments of the deployable antenna structure. Further, many of the illustrated elements of the antenna structure 110 serve the same or substantially the same purpose as the corresponding elements in antenna structures 20. These elements of antenna structure 100 are given the same reference numbers as having been accorded the corresponding elements of antenna structure 20 and will not be described further. The antenna structure 110 employs one or more reflectarray antenna elements 112 that are each tuned to compensate for unacceptable surface roughness and/or surface location precision associated with the portion of the reflector 24 underlying each element 112 that is detrimental to high frequency operation. If the underlying unacceptable surface roughness and/or surface location precision can be determined and is unlikely to change when the antenna structure 110 is in operation, each of the one or more elements 112 can be tuned during the manufacture of the antenna structure 110 and fixed in place. If, however, the unacceptable surface roughness and/or surface location precision is expected to change during operation of the antenna structure 110, the one or more elements can be coupled with a control system that allows the elements to be tuned during operation of the antenna structure 110. Further, if an array of reflectarray elements 112 are employed and the elements are tunable during operation to compensate for unacceptable surface roughness and/or surface location precision in the underlying reflector 24, the associated control circuitry can also be used to steer whatever portion of the beam is engaged by the array of reflectarray elements. With reference to FIG. 7, it should be appreciated that each of the one or more reflectarray elements 112 that are attached to the reflector 24 must be separated from reflector 24 by a dielectric 114 of an appropriate thickness, as is known to those skilled in the art. Notably, the one or more elements 112 are electrically small at lower frequencies and, as such, do not affect certain low frequency operations. As such, the reflector 24 and the one or more reflectarray elements 112 can also be used for low frequency operation of the antenna structure 110.

Figure 8:
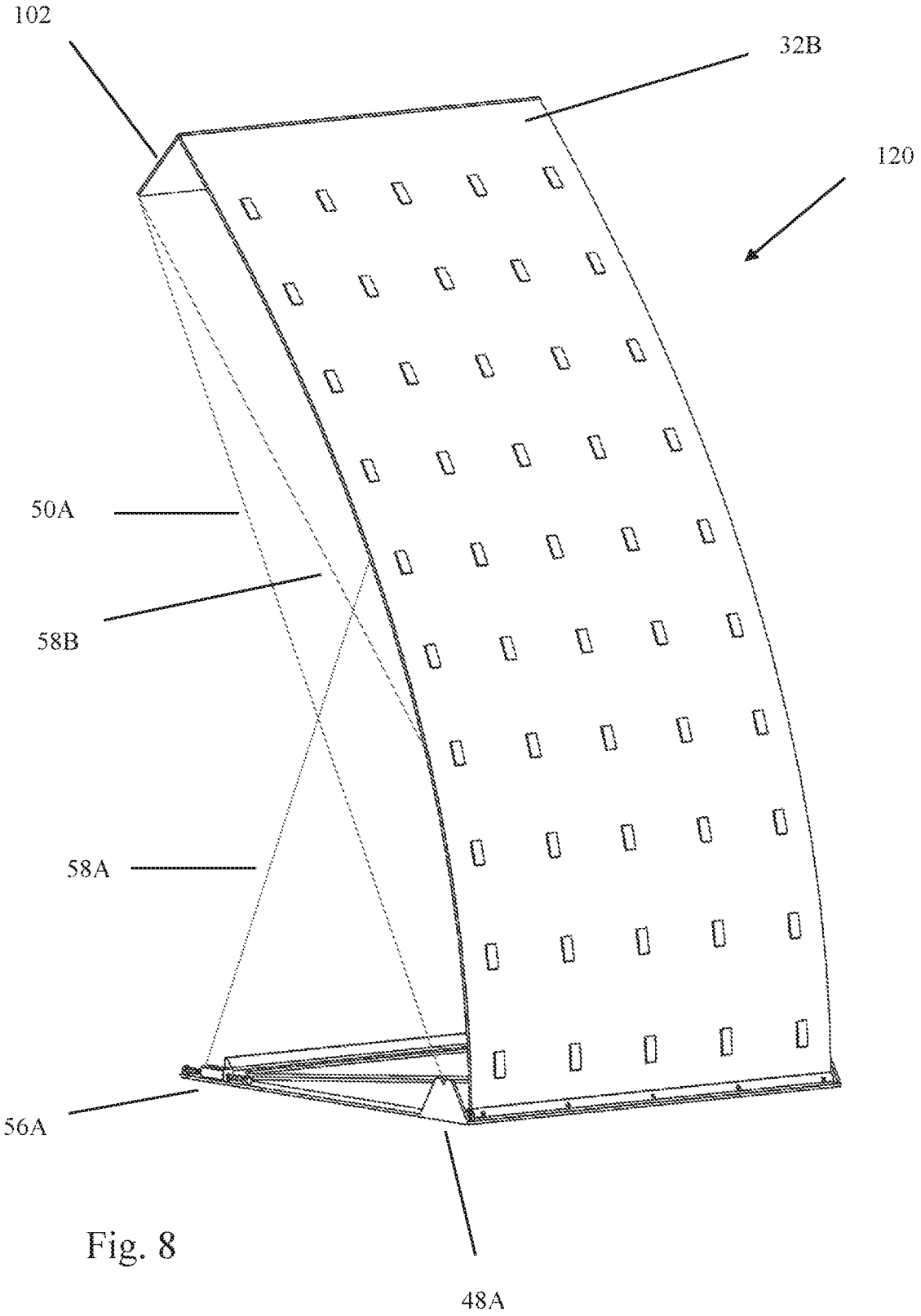
FIG. 8 is a perspective view of a fourth embodiment of a deployable antenna structure that includes an array of piezoelectric actuator that is attached to the rear surface of the reflector and used to compensate for unacceptable roughness and/or surface location precision in the reflector that would otherwise degrade high frequency performance.
Figure 9:
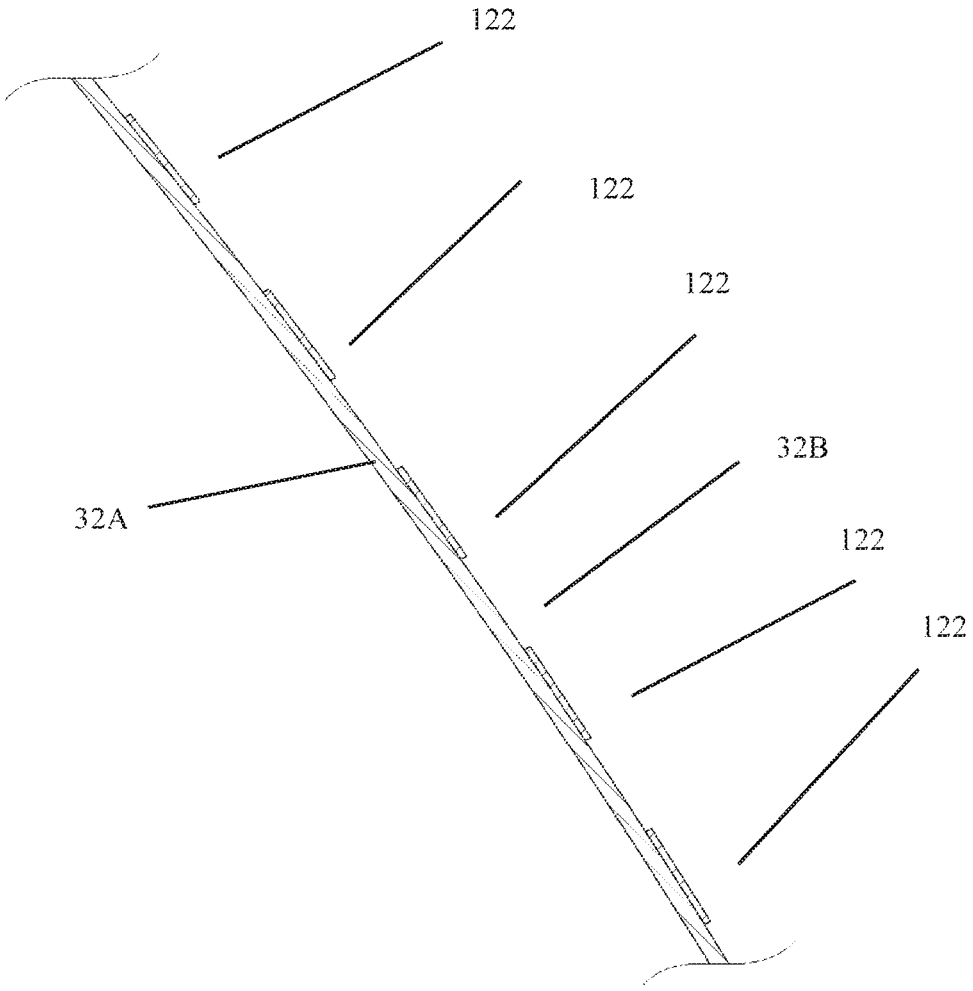
FIG. 9 is a cross-sectional view of a portion of the reflector and associated piezoelectric actuators of the embodiment of the deployable antenna structure shown in FIG. 7.

With reference to FIGS. 8 and 9, another embodiment of a deployable antenna structure 120 (hereinafter "antenna structure 120") is described. Many of the illustrated elements of the antenna structure 120 serve the same or substantially the same purpose as the corresponding elements in antenna structures 20. These elements of antenna structure 120 are given the same reference numbers as having been accorded the corresponding elements of antenna structure 20 and will not be described further. The antenna structure 120 employs one or more piezoelectric actuators 122 that are each tuned to compensate for unacceptable surface roughness and/or surface location precision associated with the portion of the reflector 24 underlying each element 122 that is detrimental to high frequency operation. If the underlying unacceptable surface roughness and/or surface location precision can be determined and is unlikely to change when the antenna structure 120 is in operation, each of the one or more actuators 122 can be tuned during the manufacture of the antenna structure 120 and fixed in place. If, however, the unacceptable surface roughness and/or surface location precision is expected to change during operation of the antenna structure 120, the one or more actuators 122 can be coupled with a control system that allows the elements to be tuned during operation of the antenna structure 110.

The foregoing description of the invention is intended to explain the best mode known of practicing the invention and to enable others skilled in the art to utilize the invention in various embodiments and with the various modifications required by their particular applications or uses of the invention.

What is claimed is:

1. A deployable cylindrical parabolic antenna comprising:

a reflector including a sheet of material, the reflector capable of being deformed from a first shape in which the sheet of material has a first amount of strain energy to a second shape in which the sheet of material has a second amount of strain energy that is greater than the first amount of strain energy;

a deployment system configured to maintain the reflector in the second shape and selectively allow the reflector to transition, by motive force provided by strain energy stored in the sheet of material, from the second shape towards the first shape but prevent the reflector from reaching the first shape such that the reflector has a third shape in which at least a portion of the reflector has a cylindrical parabolic shape; and a feed antenna located to receive an electromagnetic signal reflected by the at least a portion of the reflector having a cylindrical parabolic shape.

2. A deployable cylindrical parabolic antenna, as claimed in claim 1, wherein:

the reflector has a straight edge adapted to have a fixed angular relationship to a mounting structure and a pair of locations that define a line that is substantially parallel to, and spaced from, the straight edge when the straight edge is in the fixed angular relationship and the reflector is in the third shape.

3. A deployable cylindrical parabolic antenna, as claimed in claim 2, wherein:

the deployment system includes first, second, third and fourth lanyards with each of the first, second, third, and fourth lanyards having a first end and a second end that is separated from the first end;

a first end of each of the first and second lanyards engaging one location of the pair of locations; and a first end of each of the third and fourth lanyards engaging the other location of the pair of locations.

4. A deployable cylindrical parabolic antenna, as claimed in claim 3, wherein:

the second end of the first lanyard engages a first reel;

the second end of the third lanyard engages a second reel; and the first and second reels being adapted to dispense the first and third lanyards during the transition of the reflector between the second and third shapes.

5. A deployable cylindrical parabolic antenna, as claimed in claim 3, wherein:

the second end of the second lanyard engages a first actuator that can selectively move the location of the second end of the second lanyard; and the second end of the fourth lanyard engages a second actuator that can selectively move the location of the second end of the fourth lanyard.

6. A deployable cylindrical parabolic antenna, as claimed in claim 2, further comprising:

a standoff that extends away from the line, the standoff having a pair of engagement locations that define a line that is substantially parallel to, and spaced from, the straight edge when the straight edge is in the fixed angular relationship and the reflector is in the third shape.

7. A deployable cylindrical parabolic antenna, as claimed in claim 6, wherein:

the deployment system includes first, second, third and fourth lanyards with each of the first, second, third, and fourth lanyards having a first end and a second end that is separated from the first end;

a first end of each of the first and second lanyards engaging one location of the pair of engagement locations; and a first end of each of the third and fourth lanyards engaging the other location of the pair of engagement locations.

8. A deployable cylindrical parabolic antenna, as claimed in claim 1, wherein:

when the reflector is in the third shape, the reflector has a concave exterior surface that has the at least a portion of the reflector that has the cylindrical parabolic shape and a concave exterior surface opposite the concave exterior surface.

9. A deployable cylindrical parabolic antenna, as claimed in claim 5, further comprising:

at least one reflectarray element located adjacent to a convex exterior surface of the reflector and separated from the convex exterior surface by a dielectric.

10. A deployable cylindrical parabolic antenna, as claimed in claim 5, further comprising:

at least one piezoelectric actuator operatively attached to a convex exterior surface of the reflector.

11. A deployable cylindrical parabolic antenna, as claimed in claim 1, further comprising:

a subreflector positioned to reflect an electromagnetic signal from the reflector so as to engage the feed antenna.

12. A deployable cylindrical parabolic antenna, as claimed in claim 11, wherein:

the subreflector having a reflective surface, wherein the reflective surface has one of: (a) a concave shape and (b) a convex shape.

* * * * *